United States Patent [19]

Schmidlin

[11] 4,359,942

[45] Nov. 23, 1982

[54] SWITCH ACTUATOR

[75] Inventor: Albertus E. Schmidlin, Caldwell, N.J.

[73] Assignee: The United States of America as represented by the Secretary of the Army, Washington, D.C.

[21] Appl. No.: 216,417

[22] Filed: Dec. 15, 1980

[51] Int. Cl.[3] ..... F42C 15/00

[52] U.S. Cl. ..... 102/263; 102/223

[58] Field of Search ..... 102/263, 262, 228, 224, 102/223

[56] References Cited

U.S. PATENT DOCUMENTS

| | | | |
|---|---|---|---|
| 3,416,451 | 12/1968 | Hamerla | 102/223 |
| 3,841,220 | 10/1974 | Murphy | 102/263 |
| 4,019,441 | 4/1977 | Morgen et al. | 102/262 |
| 4,094,247 | 6/1978 | Schmidlin | 102/263 |

*Primary Examiner*—Charles T. Jordan

*Attorney, Agent, or Firm*—Nathan Edelberg; Robert P. Gibson; Max Yarmovsky

[57] ABSTRACT

An improved switch actuator, for safe and arm applications requiring utmost dependability in order to preclude a premature or false arming sequence, utilizes a plurality of simultaneous input signals from independently coded pneumatic, optical and electrical sources to drive a rotary switch. A rotary fluidic valving plate is used to decode non-uniform input optical signals into a uniform cyclical output pressure signal which is used to drive a fail-safe, reversible pneumatic gerotor type motor. A geneva mechanism is used to mechanically couple the prime mover to an output gear to activate a switch. Alternatively, an electrical switch may be incorporated within the housing of the actuator.

6 Claims, 17 Drawing Figures

SWITCH ACTUATOR

GOVERNMENTAL INTEREST

The invention described herein may be manufactured, used and licensed by or for the Government for governmental purposes without the payment to me of any royalties thereon.

BACKGROUND OF THE INVENTION

This invention is an improvement of the switch actuator shown in my U.S. Pat. No. 4,094,247 granted June 13, 1978 and is hereby incorporated by reference. That invention represented a significant advance in the art for means to safe and arm a missile and to prevent the missile from being prematurely or inadvertently detonated by an extraneous signal. It utilized a dual coded optical input which was transduced by a photosensitive cell into an electrical signal which was amplified and then converted by a solenoid means into a pneumatic signal of the same coded format. The pneumatic coded signals were decoded by a rotary decoding plate valve which was geared to a pneumatic prime mover. The prime mover was mechanically connected through a geneva drive mechanism to a rotary drive switch. The prime mover had to receive a plurality of consecutively, properly timed pneumatic pulse signals before the output switching action could be initiated by the device.

The above-mentioned prime mover was a three cylinder pneumatic motor of the piston type. Although satisfactory, it was found that this design needed improvement in sensitivity and response.

SUMMARY OF THE INVENTION

The present invention is an improved switch actuator of the type shown in U.S. Pat. No. 4,094,247. The piston type prime mover of that invention has been replaced by the novel application of the elements of a rotor type pump.

An object of the present invention is to provide an improved switch actuator for a hard switch device which cannot be accidentally or inadvertently closed.

Another object of the present invention is to provide a switch actuation with improved mechanical response and sensitivity.

For a better understanding of the present invention, together with other and further objects thereof, reference is made to the following descriptions taken in connection with the accompanying drawings.

BRIEF DESCRIPTION OF THE DRAWINGS

FIGS. 3-1 through 3-4 sequentially show the movement of the inner member of the gerotor in the gerotor housing.

FIGS. 4-1 through 4-7 is a diagramatic view of sequential movements of a valve plate, fixedly attached to an inner gerotor element, relative to an annular switch member and the gerotor housing.

FIG. 5 is a schematic cross-sectional view taken along line 5—5 of FIG. 8 through the gerotor assembly.

FIGS. 6 and 7 are sectional views taken along lines 6—6 and 7—7 of FIG. 5.

DESCRIPTION OF THE PREFERRED EMBODIMENTS

Figure 1:
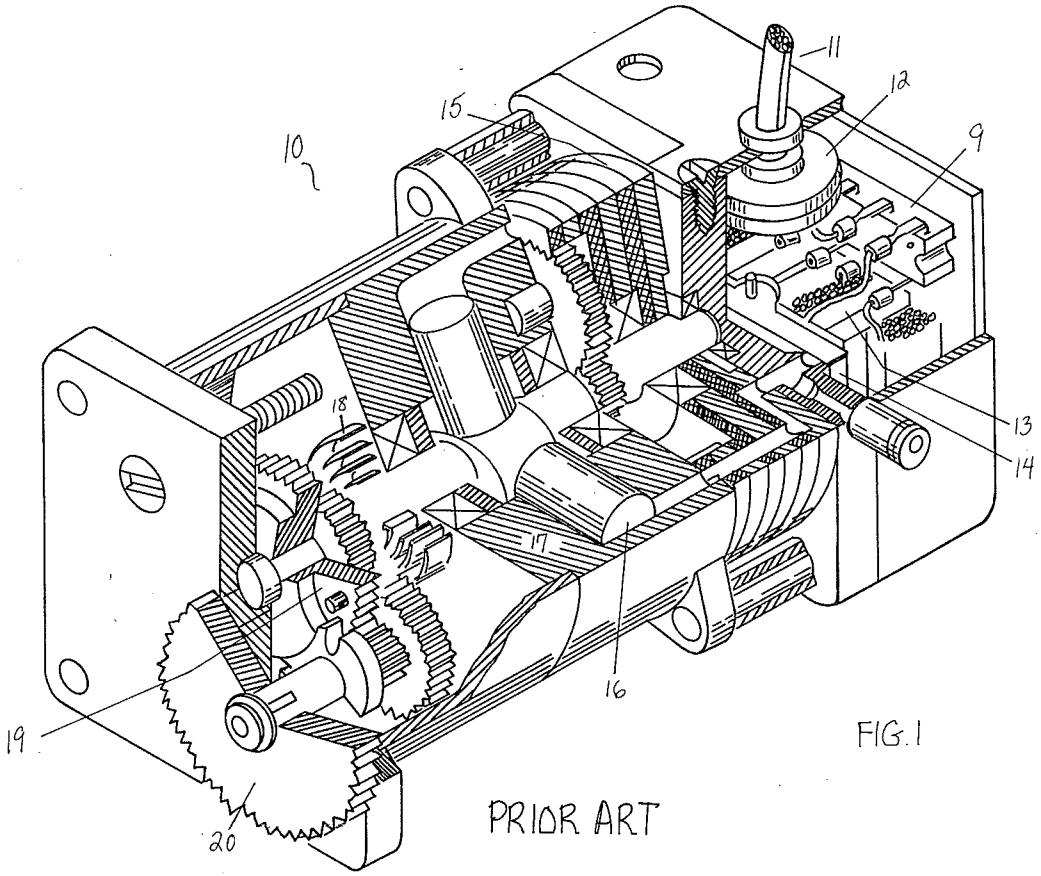
FIG. 1 PRIOR ART
FIG. 1 is a partial cutaway cross-sectional isometric view of the prior art actuator.

Referring to FIG. 1, the prior art actuator assembly 10 receives a control input coded signal by means of a fiber optic cable 11. Photosensitive cell 12 converts the coded optical signal to a coded electrical signal which is then amplified by an amplifier circuit 9 of the same format. The amplified signal operates solenoid 13 which magnetically moves pivotable flapper valve 14, creating pneumatic signals. If and when rotating valve plate 15 is favorably positioned, the pneumatic signals drive pistons 16 of prime mover 17. When the coded optical input signal is proper, the prime mover 17 biasedly winds torsion spring 18 and drives geneva type mechanism 19. An external output gear 20 serves to drive a hard switch in the warhead, both of which are not shown.

Figure 2:
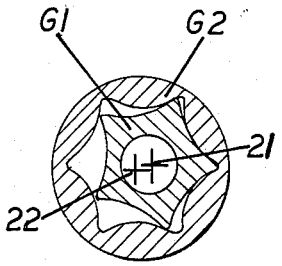
FIG. 2 shows a partial cross-sectional view of a typical gerotor type pump.

The instant invention replaces the piston type prime mover 17 with the elements of a gerotor type pump which may be used as a motor. FIG. 2 depicts a partial cross-section of a typical gerotor pump which utilizes an epitrochoidal profile. The inner element $G_1$ is driven by the shafts and rotates about the centerline 21. It also drives the outer element $G_2$ which rotates about centerline 22. When used as a pump, fluid is transported by the volumetric space between the elements, this space varying from a minimum to a maximum and back to a minimum again during one complete revolution. In the application of the gerotor in this disclosure, the elements are not used in the conventional manner. Instead, the inner member $G_1$ is allowed to orbit and rotate inside the outer member which now is fixed and stationary. In this manner a pneumatic motor is implemented. The motions and volumetric displacements are analogous to those in the Wankel engine although different in detail and function.

Figures 1, 3:
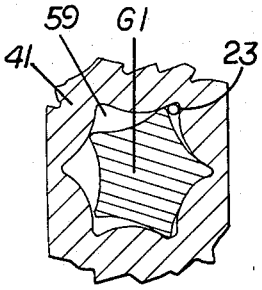
Figures 2, 3:
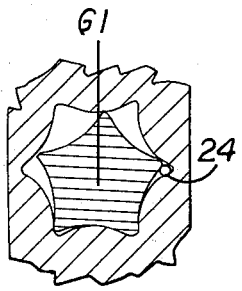
Figure 3:
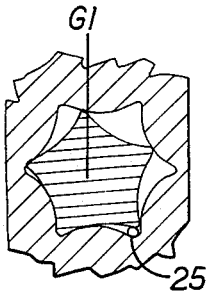
Figures 3, 4:
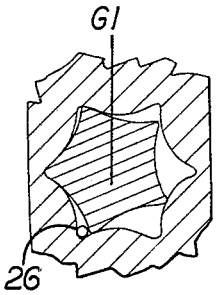

FIGS. 3-1 through 3-4 show the inner member $G_1$ in four (4) stages of rotation within an epitrochoidal cavity 59. The initial position 3-1 shows the start of rotation. The first pneumatic pulse is applied at the cusp in the housing 41 at point "23" in FIG. 3-1. This drives the inner member $G_1$ to the position shown in FIG. 3-2. The inner member $G_1$ has now begun its orbit in a clockwise direction; that is, its center is orbiting clockwise while the inner member $G_1$ itself rotates a small angle counterclockwise about its center. The next pulse is applied at "24" in FIG. 3-2 moving the inner member $G_1$ to the position shown in FIG. 3-3 where a third pulse is applied at "25", moving the inner member $G_1$ as shown in FIG. 3-4, etc. The pulse at "26" would continue the cycle. Hence the motion will continue as long as a pulse train is provided in a clockwise sequential order to continue to drive the inner member $G_1$.

The pulses which are supplied to points 23, 24, 25 and 26, consecutively, come from a valve plate fabricated in the same manner as component 15 in the prior art actuator shown in FIG. 1. As described later, the valve plate moves as an integral part of the inner member $G_1$ and orbits in the same manner. The valve plate is constructed similar to the valve plate in U.S. Pat. No. 4,094,247, and can be designed to accept 2, 3 or more channels of coded information, decode them and provide a sequential pulse train to the proper locations if, and only if the correct input code is received.

This sequence is pictured again in FIGS. 4-1 through 4-7. Here the sequentially timed pulses 27 to 32 are shown and the movement of a geared valve plate 36 and gerotor element 35 is indicated by the initial and final locations of point "33". Point "34" is a reference point on annular switch member 39.

Figures 1, 4:
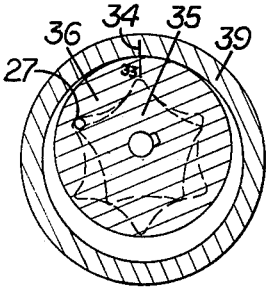
Figures 2, 4:
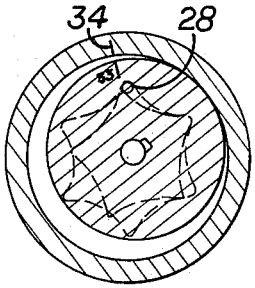
Figures 3, 4:
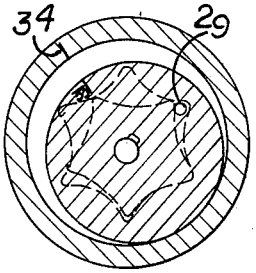
Figure 4:
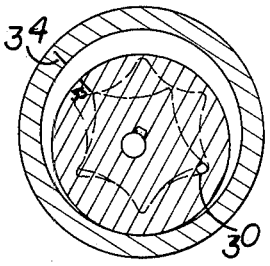
Figures 4, 5:
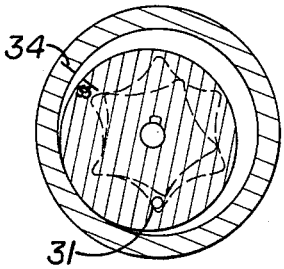
Figures 4, 5, 6:
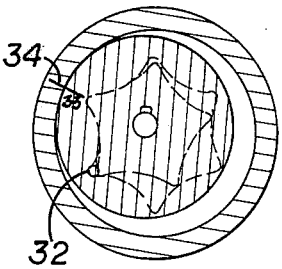
Figures 4, 5, 6, 7:
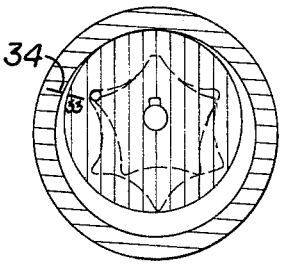

FIG. 5 portrays an optical design of the improved device; the prior art actuator 10 having incorporated an electric switch which was external to and not shown in the prior art device. The valve plate 36 is shown in additional detail in FIG. 6 and the inner gerotor member 35 is shown in FIG. 7. These two parts are keyed together by means of a key K engaging the corresponding slots in each part as shown. Hence, the valve plate 36 moves as an integral part of the inner gerotor member 35. Therefore, as pressure pulses are received in sequence as shown in FIG. 4, the gerotor gear 35 and the valve plate 36 (FIG. 6) will orbit in a clockwise direction while rotating counterclockwise. The periphery of the valve plate 36 has gear teeth 37 which engage an internal gear 38 in the annular switch member 39. The member 39 is free to rotate in a circular bearing surface 40 in the housing 41 of the device.

As the valve plate 36 with external gear teeth 37 orbits and rotates it drives the switch member 39 counterclockwise. The switch member 39 is made of insulating material. Deposited on it is an arcuate conducting layer as shown at 42. Two such layers are shown at 42 and 43 in contact with two (typical) input terminals 44 and 45. Corresponding output terminals located 90° away from terminals 44 and 45 are not shown for reasons of clarity. The circuits are closed after the switch is rotated 270° counterclockwise from the position shown in FIG. 6.

Figure 8:
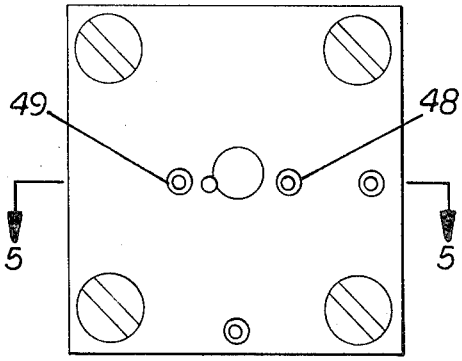
FIG. 8 is a top view of the gerotor assembly shown in FIG. 5.
Figure 7:
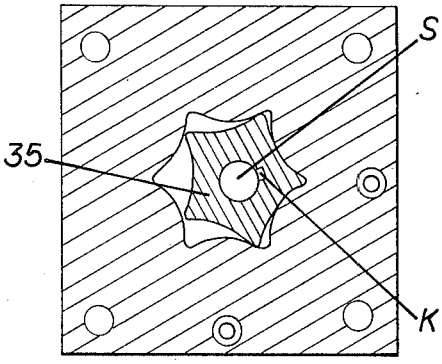
Figure 6:
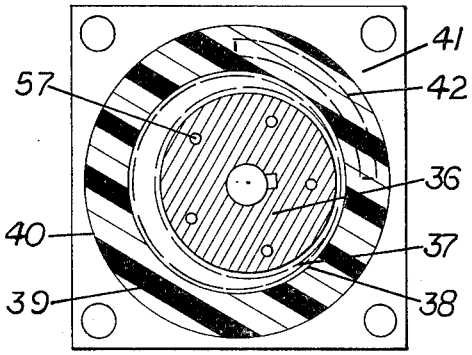
Figure 5:
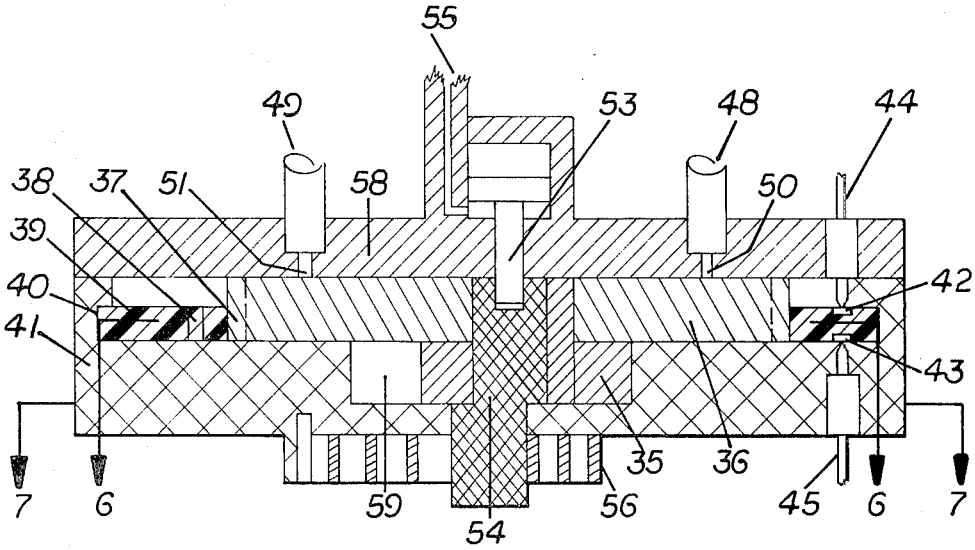

The input code is supplied to the fluidic connections in the cover plate 58 at 48 and 49 as shown in FIGS. 5 and 8. Additional input channels may be added. The input pressure pulses are conveyed to ports 50 and 51 and then to the valve plate 36. By means of cored internal passages in the valve plate 36, similar to the construction in my earlier patent, the signals are decoded and supplied to the ports 57 of the valve plate 36 in proper sequence to drive the device.

The device is locked initially by the pin 53 which engages the crank shaped shaft member 54. The lock is removed by an initial pressure applied to port 55 which raises the pin 53. A torsion spring 56 biases the driving torque and serves as a return spring to reset the device. As the proper input code is received at 48 and 49, driving pulses are received in sequence and the switch plate is driven forward. After the necessary inputs are received the switch is rotated 270° and the circuits are closed as stated earlier. Alternatively, the electrical switch may be located external to the housing and activated by the geneva mechanism when it is properly driven by the prime mover.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

I claim:

1. An improved switch actuator for safing and arming a missile:

a housing;

optical transducer means fixedly disposed in one end of the housing for converting a coded optical input pulse signal into a coded electrical signal of the same signature as the optical signal;

amplifier means electrically coupled to the optical transducer means for generating an amplified coded electrical output signal in response to the coded electrical signal;

solenoid means having a magnetically operated flapper valve member pivotally connected therewith, the solenoid means being electrically coupled to said amplifier means for converting the amplified coded electrical signal into a reciprocating mechanical motion of the flapper valve member;

pneumatic supply cover means proximately positioned adjacent to the solenoid means, the pneumatic supply cover means having two pneumatic passageways transversely diametrically disposed therethrough, for alternatively generating, in cooperation with the solenoid means, a coded pneumatic output pulse from each of the pneumatic passageways;

rotating valve plate means operatively disposed adjacent the pneumatic supply cover means, for mechanically decoding each of the coded pneumatic output pulses into sequential pressure pulses;

pneumatic gerotor type prime mover means connected to the valve plate means;

geneva movement means having a driver gear assembly and a follower assembly, the geneva movement means being gear connected to the prime mover means, the geneva driver gear assembly rotating at a predetermined relationship with the prime mover prior to the switch actuator being placed in an armed condition; and biasing means operatively disposed on the prime mover means intermediate the geneva movement means and the prime mover means for returning the switch actuator to a fail-safe position when the optical transducer means fails to receive a coded optical signal of a specific signature for a given duration.

2. A switch actuator as recited in claim 1 wherein the optical transducer means comprises:

a fiber optic cable fixedly attached to the housing for transmitting the coded optical input signal;

a photosensitive cell having an input optically in-line with the fiber optic cable for converting the coded optical input signal into the coded electrical signal.

3. A switch actuator as recited in claim 1 wherein the rotating valve plate means comprises multi-layered disc members bonded together having grooves therein, the disc members being bonded to form a valve plate having an outer face with a plurality of input ports therein which are interconnected by the grooves to a plurality of valve plate exit ports on the other side of the valve plate, the valve plate input ports being operatively disposed to receive a porting sequence, the plurality of exit ports being disposed to receive a porting interval, the interconnecting passageways acting to decode irregular coded input pulses received from the pneumatic supply cover means into regular sequenced pressure pulses to drive the pneumatic gerotor type prime mover means.

4. A switch actuator as recited in claim 1 wherein said gerotor prime move means comprises:

a housing having an epitrochoidal cavity operatively positioned therein;

cover means fixedly disposed on said housing for transferring coded pneumatic signals therethrough and for supporting a plurality of electrical conductors;

biased valve plate means rotatably positioned in said housing for decoding said pneumatic signals and for actuating an electrical circuit; and an annular plate shaped switch insulator member rotatably positioned in said housing having an integral internal gear which engages said biased valve plate means, arcuate conducting surfaces disposed on both sides thereof for making electrical connection with said electrical connectors.

5. A switch actuator as recited in claim 4 wherein said cover means includes means for pneumatically unlocking said valve plate means to rotate in said housing in response to said coded pneumatic signals.

6. A switch actuator as recited in claim 4 wherein said valve plate means includes:

an epitrochoidal gerotor inner member proximately disposed in said epitrochoidal cavity of said housing;

a valve plate member fixedly attached to said gerotor inner member having interconnecting pneumatic lines passing therethrough and communicating on one end with said cover means and on the other end with said epitrochoidal housing cavity, and external gears on the peripheral edge thereof for engaging said integral internal gear of said switch insulator member;

a crank shaped shaft rotatably supported in said housing for rotatably holding said gerotor inner member and said valve plate member; and a torsion spring operatively fixed to said housing and connected to said crank shaped shaft for returning said valve plate means to an initial position to reset said switch actuator when said switch actuator fails to receive proper series of coded pneumatic signals.

* * * * *